US006386603B1

(12) United States Patent
Huang

(10) Patent No.: US 6,386,603 B1
(45) Date of Patent: May 14, 2002

(54) LATCH BOLT ASSEMBLY FOR USE WITH A RECTANGULAR OR CIRCULAR DOOR LATCH CAVITY

(75) Inventor: Kuo-Jui Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 86 days.

(21) Appl. No.: 09/660,936

(22) Filed: Sep. 13, 2000

(51) Int. Cl.[7] ..... E05B 9/00

(52) U.S. Cl. ..... 292/337; 292/DIG. 53; 292/DIG. 64

(58) Field of Search ..... 292/337, DIG. 53, 292/DIG. 64

(56) References Cited

U.S. PATENT DOCUMENTS 4,372,594 A * 2/1983 Gater ..... 292/337
4,664,433 A * 5/1987 Solovieff ..... 292/337
5,039,146 A * 8/1991 Lin ..... 292/337
5,094,488 A * 3/1992 Boadwine et al. ..... 292/337
5,308,131 A * 5/1994 Galindo et al. ..... 292/337
5,458,382 A * 10/1995 Boadwine et al. ..... 292/337
5,474,346 A * 12/1995 Fann et al. ..... 292/337
5,662,365 A * 9/1997 Ghostley ..... 292/337
5,683,127 A * 11/1997 Chamberlain ..... 292/337
5,769,472 A * 6/1998 Small ..... 292/337

* cited by examiner

*Primary Examiner*—Teri Pham Luu
(74) *Attorney, Agent, or Firm*—Bacon & Thomas, PLLC

(57) ABSTRACT

A latch bolt assembly comprises a latch bolt device, a faceplate, and a positioning sleeve. The latch bolt device comprises a cylindrical casing, a latch bolt, and an anti-theft pin, the latch bolt and the anti-theft pin being extendible out an end of the cylindrical casing or retracted into the cylindrical casing. The end of the cylindrical casing includes a flange on an outer periphery thereof and two protrusions on the outer periphery thereof adjacent to the flange. The cylindrical casing further includes a rib formed on the outer periphery thereof. The faceplate comprises an opening so as to be mounted around the cylindrical casing of the latch bolt device and positioned between the flange and the protrusions. The positioning sleeve is mounted around the cylindrical casing of the latch bolt device and rotatably positioned between the protrusions and the rib. One of the faceplate and the positioning sleeve is selected to engage with the cylindrical casing of the latch bolt device.

12 Claims, 4 Drawing Sheets

LATCH BOLT ASSEMBLY FOR USE WITH A RECTANGULAR OR CIRCULAR DOOR LATCH CAVITY

BACKGROUND OF THE INVENTION

1. Field of the Invention

The present invention relates to a latch bolt assembly for use with a rectangular or circular door latch cavity.

2. Description of the Related Art

U.S. Pat. No. 5,308,131 issued to Galindo et al. on May 3, 1994 discloses a door latch consisting of a bolt mounted in a sharp-cornered rectangular mortise, a round-cornered rectangular mortise, or a round bored cavity defined in a door edge by means of using a faceplate and a backplate that are both interchangeable. The bolt includes two tabs protruding radially from its housing for engaging with the backplate before the bolt is engaged with the faceplate. Nevertheless, the overall thickness is increased such that the mortise or cavity in the door edge must be also increased. This causes limitation to application of the bolt.

U.S. Pat. No. 5,769,472 issued to Small on Jun. 23, 1998 discloses a drive-in housing for mounting a latch assembly in a bore formed in a door. The drive-in housing includes two identical housing parts each having a projection and a groove so as to engage with each other. When the housing parts are brought together they form an opening for receiving a bolt casing of the latch assembly. Tabs on the casing are captured in slots of the housing parts as the housing parts are moved normal to the axis of the casing. Movement of the casing relative to the housing parts is then limited by direct engagement of the housing parts with the tabs. The housing parts, when brought together, form a faceplate having an opening therein for accommodating a bolt. Such a drive-in housing is limited to be used with doors of the type having a round cavity. Namely, such a drive-in housing cannot be used with doors of the type having a rectangular mortise or cavity.

SUMMARY OF THE INVENTION

It is an object of the present invention to provide a latch bolt assembly for use with a door having either a rectangular or circular cavity by means of using a faceplate or positioning sleeve.

It is another object of the present invention to provide a latch bolt assembly wherein the latch bolt device can be rotated to a proper position even after the latch bolt device has been mounted in a circular door cavity.

A latch bolt assembly in accordance with the present invention comprises a latch bolt device, a faceplate, and a positioning sleeve. The latch bolt device comprises a cylindrical casing, a latch bolt, and an anti-theft pin, the latch bolt and the anti-theft pin being extendible out an end of the cylindrical casing or retracted into the cylindrical casing. The end of the cylindrical casing includes a flange on an outer periphery thereof and two protrusions on the outer periphery thereof adjacent to the flange. The cylindrical casing further includes a rib formed on the outer periphery thereof.

The faceplate comprises an opening so as to be mounted around the cylindrical casing of the latch bolt device and positioned between the flange and the protrusions. The positioning sleeve is mounted around the cylindrical casing of the latch bolt device and rotatably positioned between the protrusions and the rib. One of the faceplate and the positioning sleeve is selected to engage with the cylindrical casing of the latch bolt device.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 1:
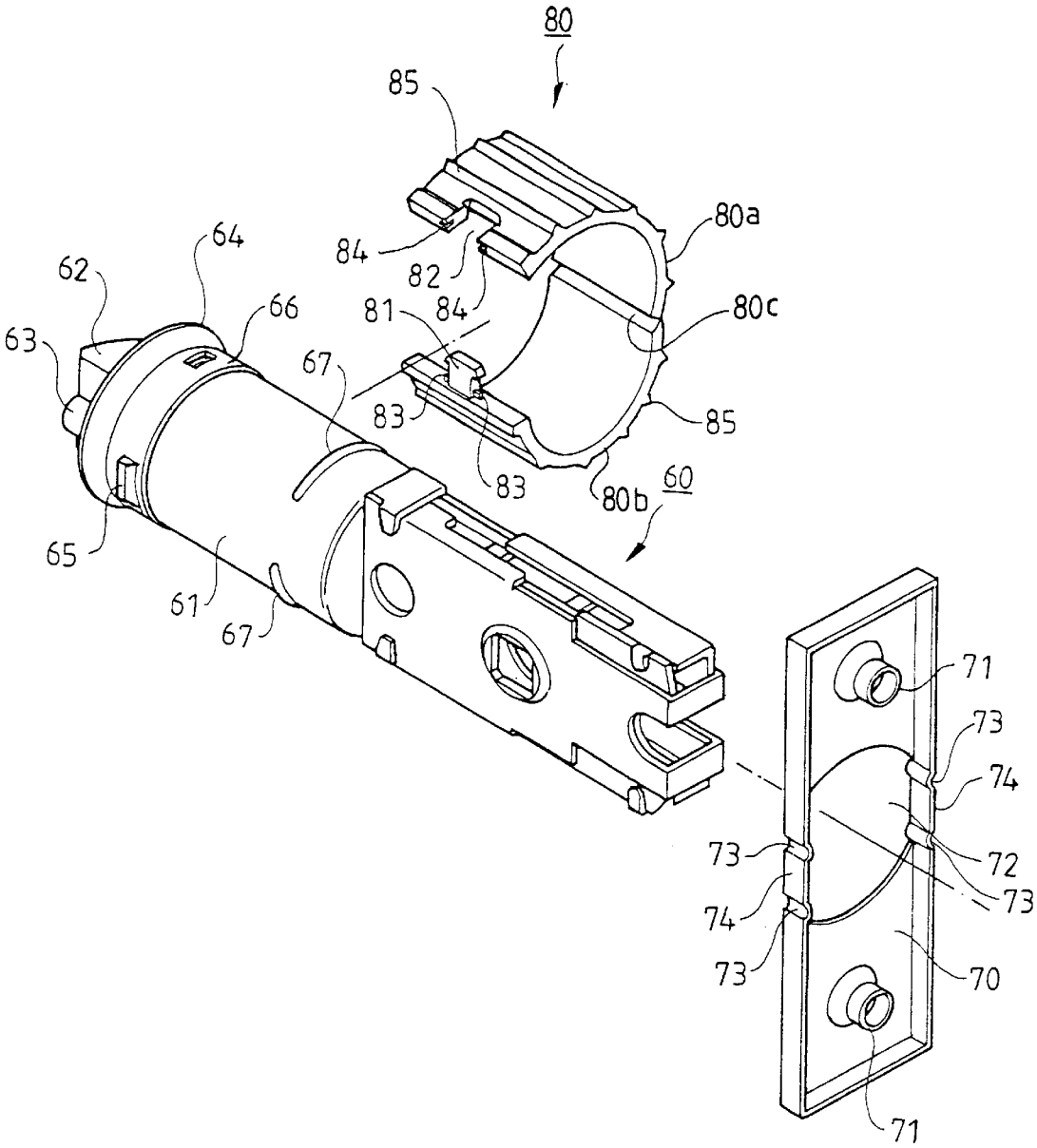
FIG. 1 is an exploded perspective view of a latch bolt assembly in accordance with the present invention comprises a latch bolt device, a faceplate, and a positioning sleeve.
Figure 2:
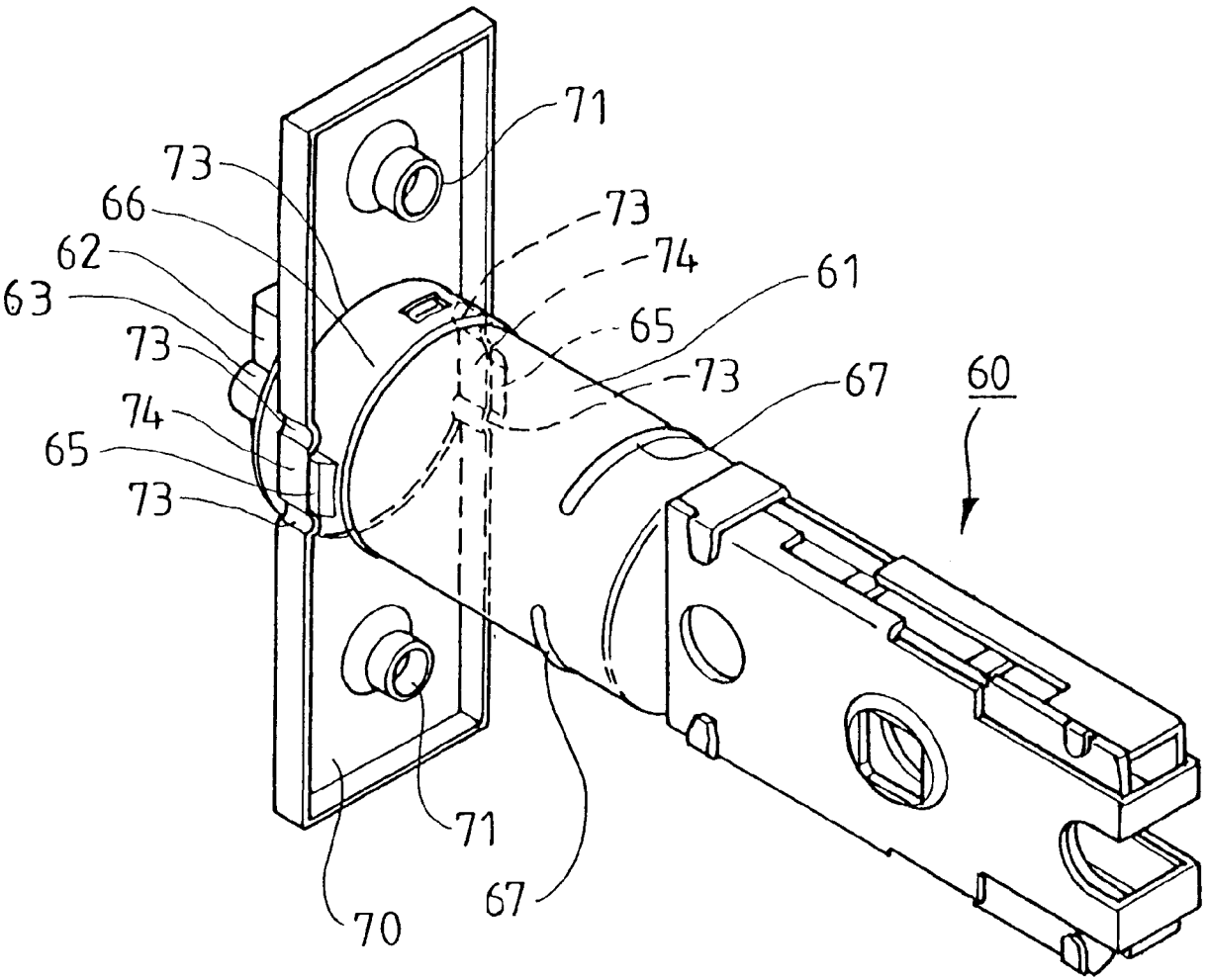
FIG. 2 is a perspective view of the latch bolt device used with the faceplate.

Referring to FIGS. 1 and 2, a latch bolt assembly in accordance with the present invention generally includes a latch bolt device 60, a faceplate 70, and a positioning sleeve 80. The latch bolt device 60 may be a conventional design of cylindrical locks, tubular locks, or auxiliary locks. As shown in the figures, the latch bolt device 60 is a conventional latch bolt device for an auxiliary lock and includes a cylindrical casing 61, a latch bolt 62 and an anti-theft pin 63 that are extendible out of an end of the cylindrical casing 61 or retracted into the cylindrical casing 61. The end of the cylindrical casing 61 includes a flange 64 and two diametrically disposed protrusions 65 adjacent to the flange 64. In an embodiment of the invention, the flange 64 and the protrusions 65 are both formed on a collar 66 that is secured on the an outer periphery of the cylindrical casing 61 by punching or welding. The cylindrical casing 61 further includes a rib 67 formed on the outer periphery thereof.

Figure 3:
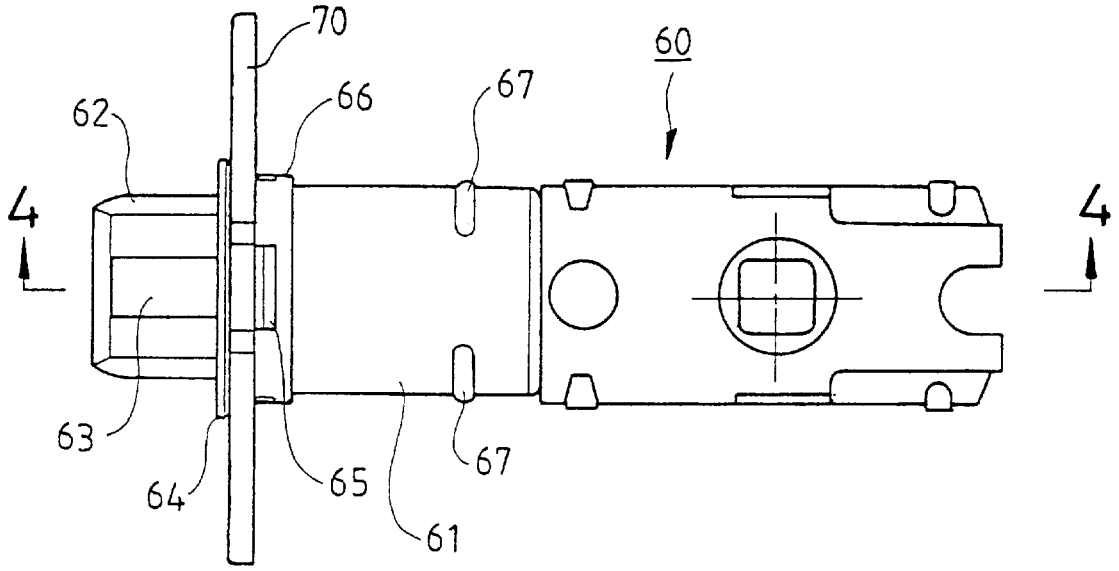
FIG. 3 is a side view of the latch bolt assembly in FIG. 2.
Figure 4:
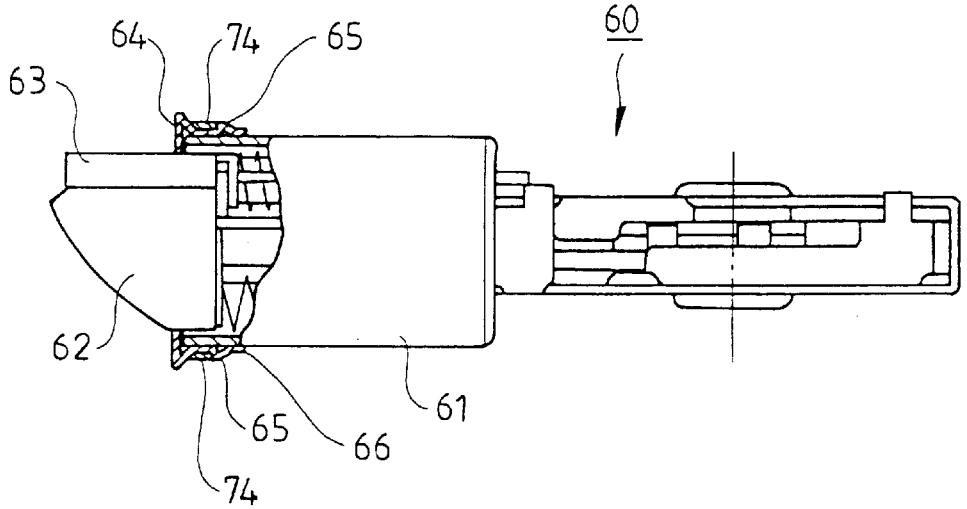
FIG. 4 is a sectional view taken along line 4—4 in FIG. 3.

The faceplate 70 is rectangular and includes positioning holes 71 so as to be screwed onto a door edge (not shown) having a cavity (not shown) defined therein. The faceplate 70 further includes an opening 72 so as to be mounted around the cylindrical casing 61 and positioned between the flange 64 and the protrusions 65, as shown in FIGS. 2 and 3. It is noted that the faceplate 70 includes two lateral sides 74 each of which is securely positioned between the flange 64 and an associated protrusion 65. Each lateral side 74 has a thickness that is punched inward to form, e.g., two arcuate sections 73 by means of, e.g., punching. A positioning section (not labeled) is defined between the arcuate sections 73. It is noted that the positioning section of each lateral side 74 of the faceplate 70 is securely positioned between the flange 64 and the associated protrusion 65. The lateral side 74 is expandable to allow easy installation of the faceplate 70 between the flange 64 and the protrusions 65. When the cavity in the door edge is rectangular, the faceplate 70 is mounted on the cylindrical casing 61 so as to be fittingly engaged in the rectangular cavity in the door edge.

The positioning sleeve 80 is used when the cavity in the door edge is circular. The positioning sleeve 80 is mounted between the protrusions 65 and the rib 67 and is rotatable relative to the cylindrical casing 61. In a preferred embodiment, the positioning sleeve 80 is made from plastic material and includes two casing parts 80*a* and 80*b*. As illustrated in FIG. 1, the casing part 80*a* has a first end that is pivotally connected with a first end of the casing part 80*b*. In this embodiment, the first ends of the casing parts 80*a* and 80*b* are integrally formed with each other with a groove 80*c* defined along a length of a junction area between the first ends of the casing parts 80*a* and 80*b*.

A second end of the casing part 80*a* includes a substantially T-shape engaging notch 82 and a second end of the casing part 80*b* includes a substantially T-shape engaging tab 81 for releasably engaging with the engaging notch 82. In addition, each of two lateral sides that define the engaging notch 82 includes an auxiliary engaging notch 84, and each of two lateral sides of the engaging tab 81 includes an auxiliary engaging protrusion 83 for engaging with an associated auxiliary engaging notch 84 to prevent disengagement of the engaging tab 81 from the engaging notch 82. Further, the positioning sleeve 80 includes a rugged outer periphery thereof, e.g., in the form of a plurality of ridges 85 on the outer periphery. The ridges 85 bite into the wood of the door bounding the door cavity to thereby prevent rotation of the positioning sleeve relative to the door.

Figure 5:
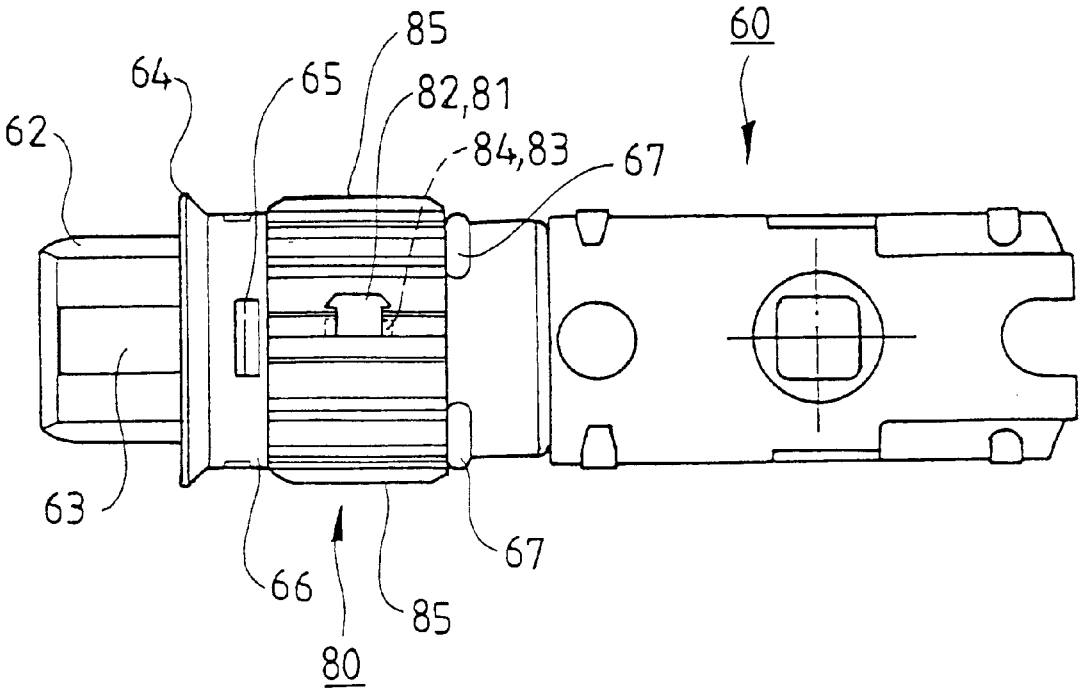
FIG. 5 is a side view of the latch bolt device used with the positioning sleeve.

As illustrated in FIG. 5, when the cavity in the door edge is circular, the positioning sleeve 80 is mounted between the protrusions 65 and the rib 67 and is rotatable relative to the cylindrical casing 61. After the ridges 85 of the positioning sleeve 80 have bitten into the wood of the door bounding the door cavity, the cylindrical casing 61 is still rotatable relative to the positioning sleeve 80 to a proper position for the latch bolt device 60.

According to the above description, it is appreciated that the latch bolt assembly in accordance with the present invention can be used with a door having either a rectangular or circular cavity by means of using a faceplate or positioning sleeve. In addition, when a positioning sleeve is used, the latch bolt device can be rotated to a proper position.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A latch bolt assembly comprising:

a latch bolt device comprising a cylindrical casing, a latch bolt, and an anti-theft pin, the latch bolt and the anti-theft pin being extendible out an end of the cylindrical casing or retracted into the cylindrical casing, the end of the cylindrical casing including a flange on an outer periphery thereof and two protrusions on the outer periphery thereof adjacent to the flange, the cylindrical casing further including a rib formed on the outer periphery thereof;

a faceplate comprising an opening so as to be mounted around the cylindrical casing of the latch bolt device and positioned between the flange and the protrusions; and a positioning sleeve mounted around the cylindrical casing of the latch bolt device and rotatably positioned between the protrusions and the rib;

wherein one of the faceplate and the positioning sleeve is selected to engage with the cylindrical casing of the latch bolt device.

2. The latch bolt assembly as claimed in claim 1, wherein the flange and the protrusions are both formed on a collar that is secured on an outer periphery of the cylindrical casing.

3. The latch bolt assembly as claimed in claim 1, wherein the faceplate includes two lateral sides each of which is securely positioned between the flange and an associated said protrusion.

4. The latch bolt assembly as claimed in claim 3, wherein each said lateral side of the faceplate has a thickness that is punched inward to form two arcuate sections and a positioning section between the arcuate sections, and wherein the positioning section of each said lateral side of the faceplate is securely positioned between the flange and the associated protrusion.

5. The latch bolt assembly as claimed in claim 1, wherein the faceplate is rectangular and includes positioning holes so as to be screwed onto a door edge.

6. The latch bolt assembly as claimed in claim 1, wherein the positioning sleeve includes a first casing part and a second casing part that together form a ring-like structure, each of the first casing part and the second casing part including a first end and a second end, the first end of the first casing part and the first end of the second casing part are integrally formed and pivotable relative to each other, the second end of the first casing part and the second end of the second casing part are releasably engaged with each other.

7. The latch bolt assembly as claimed in claim 6, wherein the second end of the first casing includes an engaging notch, and wherein the second end of the second casing includes an engaging tab.

8. The latch bolt assembly as claimed in claim 7, wherein each of two lateral sides defining the engaging notch includes an auxiliary engaging notch, and wherein the engaging tab includes two lateral sides each having an auxiliary engaging protrusion for releasably engaging with an associated said auxiliary engaging notch.

9. The latch bolt assembly as claimed in claim 6, wherein the positioning sleeve includes a rugged outer periphery.

10. The latch bolt assembly as claimed in claim 6, wherein the positioning sleeve includes a plurality of ridges.

11. The latch bolt assembly as claimed in claim 1, wherein the positioning sleeve includes a plurality of ridges.

12. The latch bolt assembly as claimed in claim 1, wherein the positioning sleeve includes a rugged outer periphery.

* * * * *